US009758741B2

(12) United States Patent
Nakagawa et al.

(10) Patent No.: US 9,758,741 B2
(45) Date of Patent: Sep. 12, 2017

(54) COAL DEACTIVATION PROCESSING DEVICE

(71) Applicant: MITSUBISHI HEAVY INDUSTRIES, LTD., Tokyo (JP)

(72) Inventors: Keiichi Nakagawa, Tokyo (JP); Setsuo Omoto, Tokyo (JP); Fumiaki Sato, Tokyo (JP)

(73) Assignee: MITSUBISHI HEAVY INDUSTRIES, LTD., Tokyo (JP)

( * ) Notice: Subject to any disclaimer, the term of this patent is extended or adjusted under 35 U.S.C. 154(b) by 50 days.

(21) Appl. No.: 14/408,784

(22) PCT Filed: Sep. 30, 2013

(86) PCT No.: PCT/JP2013/076477
§ 371 (c)(1),
(2) Date: Dec. 17, 2014

(87) PCT Pub. No.: WO2014/057829
PCT Pub. Date: Apr. 17, 2014

(65) Prior Publication Data

US 2015/0210945 A1 Jul. 30, 2015

(30) Foreign Application Priority Data

Oct. 9, 2012 (JP) ..... 2012-224037

(51) Int. Cl.
*C10L 9/06* (2006.01)
*C10L 9/08* (2006.01)

(52) U.S. Cl.
CPC *C10L 9/06* (2013.01); *C10L 9/08* (2013.01); *C10L 2230/14* (2013.01); *C10L 2290/06* (2013.01); *C10L 2290/58* (2013.01)

(58) Field of Classification Search
CPC ..... C10L 9/06; C10L 9/08; C10L 2290/58; C10L 2290/06; C10L 2230/14
See application file for complete search history.

(56) References Cited

U.S. PATENT DOCUMENTS 3,723,079 A 3/1973 Seitzer
4,249,909 A 2/1981 Comolli
(Continued)

FOREIGN PATENT DOCUMENTS

AU 2011342432 B2 6/2012
CN 1039052 A 1/1990
(Continued)

OTHER PUBLICATIONS

Notification of Transmital of translation of the International Preliminary Report of the International Preliminary Report on Patentability (Chapter I or ChapterII) (Form PCT/IB/338) of the International Application No. PCT/JP2012/083230 mailed Jul. 17, 2014 with forms PCT/IB/373 and PCT/ISA/237.
(Continued)

*Primary Examiner* — Shogo Sasaki
(74) *Attorney, Agent, or Firm* — Westerman, Hattori, Daniels & Adrian, LLP

(57) ABSTRACT

The present invention is provided with: a first processing device main body (111) that processes carbonized coal (1) by means of processing gas (103) of which the oxygen concentration has been adjusted by blowers (113,115); a second processing device main body (121) that processes primary processed carbonized coal (2*a*), which results from being processed at the first processing device main body, by means of air (102) fed by a blower (122); a second-processing-gas state detection means that detects the state of the air used within the second processing device main body; and a control device (130) that, on the basis of information from the second-processing—gas state detection means,
(Continued)

controls the blowers (113,115) in a manner so as to adjust the oxygen concentration in the processing gas when the state of the air has diverged from a predetermined state.

13 Claims, 3 Drawing Sheets

(56) References Cited

U.S. PATENT DOCUMENTS

| | | | | |
|---|---|---|---|---|
| 4,402,706 | A | 9/1983 | Wunderlich | |
| 4,797,136 | A | 1/1989 | Siddoway et al. | |
| 4,828,576 | A * | 5/1989 | Bixel | C10L 9/10 44/501 |
| 5,035,721 | A * | 7/1991 | Atherton | C10L 9/00 44/501 |
| 5,137,539 | A * | 8/1992 | Bowling | F01K 17/06 34/443 |
| 5,290,523 | A * | 3/1994 | Koppelman | C10L 9/00 165/267 |
| 5,324,336 | A * | 6/1994 | Child | C10J 3/466 252/373 |
| 5,711,769 | A | 1/1998 | Rinker et al. | |
| 5,746,787 | A | 5/1998 | Koppelman | |
| 5,840,651 | A | 11/1998 | Hanashita et al. | |
| 5,863,304 | A | 1/1999 | Viall et al. | |
| 6,090,171 | A | 7/2000 | Viall et al. | |
| 6,146,432 | A | 11/2000 | Ochs et al. | |
| 6,436,158 | B1 | 8/2002 | Fujikawa et al. | |
| 6,878,174 | B1 * | 4/2005 | Conochie | C10L 9/00 44/620 |
| 8,671,586 | B2 | 3/2014 | Bonner et al. | |
| 8,951,311 | B2 | 2/2015 | Rozelle et al. | |
| 9,290,711 | B2 | 3/2016 | Sato et al. | |
| 9,464,245 | B2 | 10/2016 | Gao et al. | |
| 2011/0059410 | A1 | 3/2011 | Glynn | |
| 2011/0126743 | A1 | 6/2011 | Takase et al. | |
| 2014/0345193 | A1 | 11/2014 | Nakagawa et al. | |
| 2014/0366433 | A1 | 12/2014 | Kaneko et al. | |
| 2014/0373436 | A1 | 12/2014 | Nakagawa et al. | |
| 2015/0329793 | A1 | 11/2015 | Kaneko et al. | |
| 2015/0376531 | A1 | 12/2015 | Atarashiya et al. | |

FOREIGN PATENT DOCUMENTS

| | | | |
|---|---|---|---|
| CN | 1010482 | B | 11/1990 |
| CN | 1597283 | A | 3/2005 |
| CN | 101429463 | A | 5/2009 |
| CN | 101781596 | A | 7/2010 |
| CN | 103180418 | A | 6/2013 |
| DE | 44 98 936 | T1 | 12/1995 |
| EP | 0 758 677 | A1 | 2/1997 |
| GB | 1423187 | A | 1/1976 |
| JP | 59-74189 | A | 4/1984 |
| JP | 59-227979 | A | 12/1984 |
| JP | 6065097 | A | 4/1985 |
| JP | 9-71791 | A | 3/1997 |
| JP | 11-310785 | A | 11/1999 |
| JP | 3669373 | B2 | 7/2005 |
| JP | 2007-237011 | A | 9/2007 |
| JP | 2007-536392 | A | 12/2007 |
| JP | 2010-265394 | A | 11/2010 |
| JP | 201137938 | A | 2/2011 |
| JP | 2012-126856 | A | 7/2012 |
| JP | 2013-139536 | A | 7/2013 |
| WO | 95/13868 | A1 | 5/1995 |
| WO | 2011/016371 | A1 | 2/2011 |
| WO | 2012/058851 | A1 | 5/2012 |
| WO | 2012/081371 | A1 | 6/2012 |
| WO | 2013/103096 | A1 | 7/2013 |

OTHER PUBLICATIONS

Chinese Office Action dated Nov. 21, 2014, issued in corresponding Chinese Patent Application No. 201280056170.0, w/English translation (10 pages).

Office Action dated Feb. 12, 2016, issued in counterpart German Patent Application No. 11 2012 005 574.8, with English translation. (10 pages).

International Search Report dated Mar. 11, 2014, issued in corresponding application No. PCT/JP2014/050894, with forms PCT/IB/373 and PCT/ISA/237, w/English translations. (8 pages).

Japanese Notice of Allowance dated Dec. 10, 2014, issued in corresponding Japanese Application No. 2012-0000940; w/English translation. (6 pages).

Notification of Transmittal of translation of the International Preliminary Report on Patentability (Form PCT/IB/338) issued in counterpart International Application No. PCT/JP2014/050894 mailed Sep. 17, 2015 with forms PCT/IB/373, PCT/ISA/237, PCT/ISA/220, w/English translation (12 pages).

Office Action dated Jul. 4, 2016, issued in Chinese Application 201480011537.6, with English translation. (21 pages).

Non-Final Office Action dated Oct. 26, 2016, issued in U.S. Appl. No. 14/769,942 (31 pages).

International Search Report dated Nov. 5, 2013, issued in corresponding application No. PCT/JP2013/076477, with forms PCT/IB/338, PCT/IB/373 and PCT/ISA/237, w/English translations.(17 pages).

Final Office Action dated Feb. 1, 2017, issued in U.S. Appl. No. 14/769,942 (13 pages).

* cited by examiner

COAL DEACTIVATION PROCESSING DEVICE

TECHNICAL FIELD

The present invention relates to a coal deactivation processing device configured to deactivate coal by using processing gas containing oxygen.

BACKGROUND ART

Pyrolized coal tends to be activated and bond with oxygen. Accordingly, when the pyrolized coal is stored as it is, the coal may react with oxygen in the air and spontaneously combust due to heat generated by this reaction. In view of this, the pyrolized coal is exposed to a processing gas atmosphere containing a low concentration of oxygen to deactivate the coal by making it bond with oxygen in advance, and spontaneous combustion in storage is thus prevented.

When characteristics (for example, type of coal, particle diameter, amount of water content, stored period, and the like) of the aforementioned coal being the target of pyrolysis and conditions of the pyrolysis (for example, pyrolysis temperature, pyrolysis time, pyrolysis processing amount, and the like) of the coal vary, the degree of activity of the pyrolized coal supplied to deactivation processing also varies. Accordingly, when pyrolized coals with different degrees of activation are subjected to the deactivation processing by a deactivation processing device under the same condition, the degree of activity of the pyrolized coal (upgraded coal) subjected to the deactivation processing and discharged from the deactivation processing device varies.

When the pyrolized coal is excessively subjected to the deactivation processing, the amount of oxygen contained in the upgraded coal increases and the heating value of the upgraded coal decreases depending on the amount of contained oxygen. Meanwhile, when the deactivation of the pyrolized coal is insufficient, the upgraded coal may react with oxygen in the air and spontaneously combust due to the heat of this reaction while the upgrade coal is stored in, for example, a coal yard. Accordingly, in order to obtain an upgraded coal which has a sufficient heating value and which does not spontaneously combust in long-term storage and thus has good handling characteristics, the upgraded coal needs to be adjusted to an appropriate degree of inactivity.

For example, Patent Document 1 listed below describes a coal deactivation processing device as follows. The device takes part of upgraded coal produced by subjecting pyrolized coal to deactivation processing as a sample and puts the sample into an evaluation device main body. Then, oxygen-containing gas of a predetermined temperature is supplied into the evaluation device main body, and the temperature of the gas discharged from the evaluation device main body is measured. If a measured value exceeds a threshold value, the device determines that the degree of inactivity of the upgraded coal is insufficient, and adjusts the oxygen concentration of the processing gas in the deactivation processing of the pyrolized coal.

Patent Document 2 listed below describes a method of using blended coal which is prevented from spontaneously combusting by mixing active coal and inactive coal such that the blended coal has an oxygen adsorption rate equal to or lower than the oxygen adsorption rate of coal for which safety is confirmed.

PRIOR ART DOCUMENT

Patent Document

Patent Document 1: Japanese Patent Application Publication No. 2012-126856

Patent Document 2: Japanese Patent Application Publication No. 2010-265394

SUMMARY OF THE INVENTION

Problems to be Solved by the Invention

However, in the aforementioned deactivation processing device described in Patent Document 1, although the upgraded coal adjusted to an appropriate degree of inactivity can be obtained, there is a need to take part of the obtained upgraded coal as a sample and analyze the degree of inactivity of the sampled upgraded coal. Accordingly, the device itself may become complex.

In Patent Document 2 mentioned above, the oxygen adsorption rate of each of the active coal and the inactive coal needs to be measured in a case of blending the active coal and the inactive coal. Accordingly, when this technique is implemented as a device, the device may become complex. Moreover, when the amount of the activated coal is great, the amount of the inactive coal to be blended needs to be increased according to the amount of the activated coal. Hence, the amount of inputted energy is great and the technique is not efficient.

In view of the above circumstances, the present invention has been made to solve the problems described above, and an object thereof is to provide a coal deactivation processing device capable of easily obtaining upgraded coal adjusted to an appropriate degree of inactivity.

Means for Solving the Problems

A coal deactivation processing device of a first aspect of the invention for solving the problems described above is characterized in that, the coal deactivation processing device comprises: a first processing device main body in which coal flows from one side to another side; first-processing-gas feeding means for feeding first processing gas containing oxygen into the first processing device main body; first-processing-gas oxygen concentration adjustment means for adjusting an oxygen concentration in the first processing gas; first-processing-gas temperature adjustment means for adjusting a temperature of the first processing gas; a second processing device main body which is located in a stage prior or subsequent to the first processing device main body and in which the coal or the coal processed in the first processing device main body flows from one side to another side; second-processing-gas feeding means for feeding second processing gas containing a predetermined concentration of oxygen into the second processing device main body; second-processing-gas state detection means for detecting a state of the second processing gas used to process the coal in the second processing device main body; and control means for controlling the first-processing-gas oxygen concentration adjustment means based on information from the second-processing-gas state detection means, such that the oxygen concentration in the first processing gas is adjusted, when the state of the second processing gas deviates from a predetermined state.

A coal deactivation processing device of a second aspect of the invention for solving the problems described above is the aforementioned coal deactivation processing device of the first aspect of the invention, characterized in that the second-processing-gas state detection means is second-processing-gas oxygen concentration detection means for detecting an oxygen concentration of the second processing gas used to process the coal in the second processing device main body, and based on information from the second-processing-gas oxygen concentration detection means, the control means: controls the first-processing-gas oxygen concentration adjustment means such that the oxygen concentration in the first processing gas is increased, when the oxygen concentration of the second processing gas is lower than a predetermined oxygen concentration; and controls the first-processing-gas oxygen concentration adjustment means such that the oxygen concentration in the first processing gas is reduced, when the oxygen concentration of the second processing gas is equal to or higher than the predetermined oxygen concentration.

A coal deactivation processing device of a third aspect of the invention for solving the problems described above is the aforementioned coal deactivation processing device of the first aspect of the invention, characterized in that the second-processing-gas state detection means is second-processing-gas carbon monoxide concentration detection means or second-processing-gas carbon dioxide concentration detection means for actually detecting a carbon monoxide concentration or a carbon dioxide concentration of the second processing gas used to process the coal in the second processing device main body, and based on information from the second-processing-gas carbon monoxide concentration detection means or the second-processing-gas carbon dioxide concentration detection means, the control means: controls the first-processing-gas oxygen concentration adjustment means such that the oxygen concentration in the first processing gas is increased, when the carbon monoxide concentration or the carbon dioxide concentration in the second processing gas is higher than a predetermined concentration; and controls the first-processing-gas oxygen concentration adjustment means such that the oxygen concentration in the first processing gas is reduced, when the carbon monoxide concentration or the carbon dioxide concentration in the second processing gas is equal to or lower than the predetermined concentration.

A coal deactivation processing device of a fourth aspect of the invention for solving the problems described above is the aforementioned coal deactivation processing device of the first aspect of the invention, characterized in that the second-processing-gas state detection means is second-processing-gas temperature detection means for actually detecting a temperature of the second processing gas used to process the coal in the second processing device main body, and based on information from the second-processing-gas temperature detection means, the control means: controls the first-processing-gas oxygen concentration adjustment means such that the oxygen concentration in the first processing gas is reduced, when the temperature of the second processing gas is low and equal to or lower than a predetermined temperature; and controls the first-processing-gas oxygen concentration adjustment means such that the oxygen concentration in the first processing gas is increased, when the temperature of the second processing gas is higher than the predetermined temperature.

A coal deactivation processing device of a fifth aspect of the invention for solving the problems described above is the aforementioned coal deactivation processing device of any one of the first to fourth aspects of the invention, characterized in that the coal deactivation processing device further comprises second-processing-gas temperature adjustment means for adjusting a temperature of the second processing gas.

A coal deactivation processing device of a sixth aspect of the invention for solving the problems described above is the aforementioned coal deactivation processing device of any one of the first to fifth aspects of the invention, characterized in that the coal deactivation processing device further comprises second-processing-gas oxygen concentration adjustment means for adjusting an oxygen concentration of the second processing gas to a predetermined concentration.

Effect of the Invention

In the coal deactivation processing device of the present invention, unlike the conventional coal deactivation processing device, there is no need to take part of upgraded coal produced by subjecting pyrolized coal to deactivation processing as a sample, and the oxygen concentration of the processing gas to be fed to the first processing device main body can be adjusted based on the state of the exhaust gas exhausted from the second processing device main body. Moreover, the pyrolized coal can be subjected to the deactivation processing in the first processing device main body and the second processing device main body. Accordingly, upgraded coal adjusted to an appropriate degree of inactivity can be easily obtained.

MODE FOR CARRYING OUT THE INVENTION

Embodiments of a coal deactivation processing device in the present invention are described based on the drawings. However, the present invention is not limited to the embodiments described below based on the drawings.

First Embodiment

Figure 1:
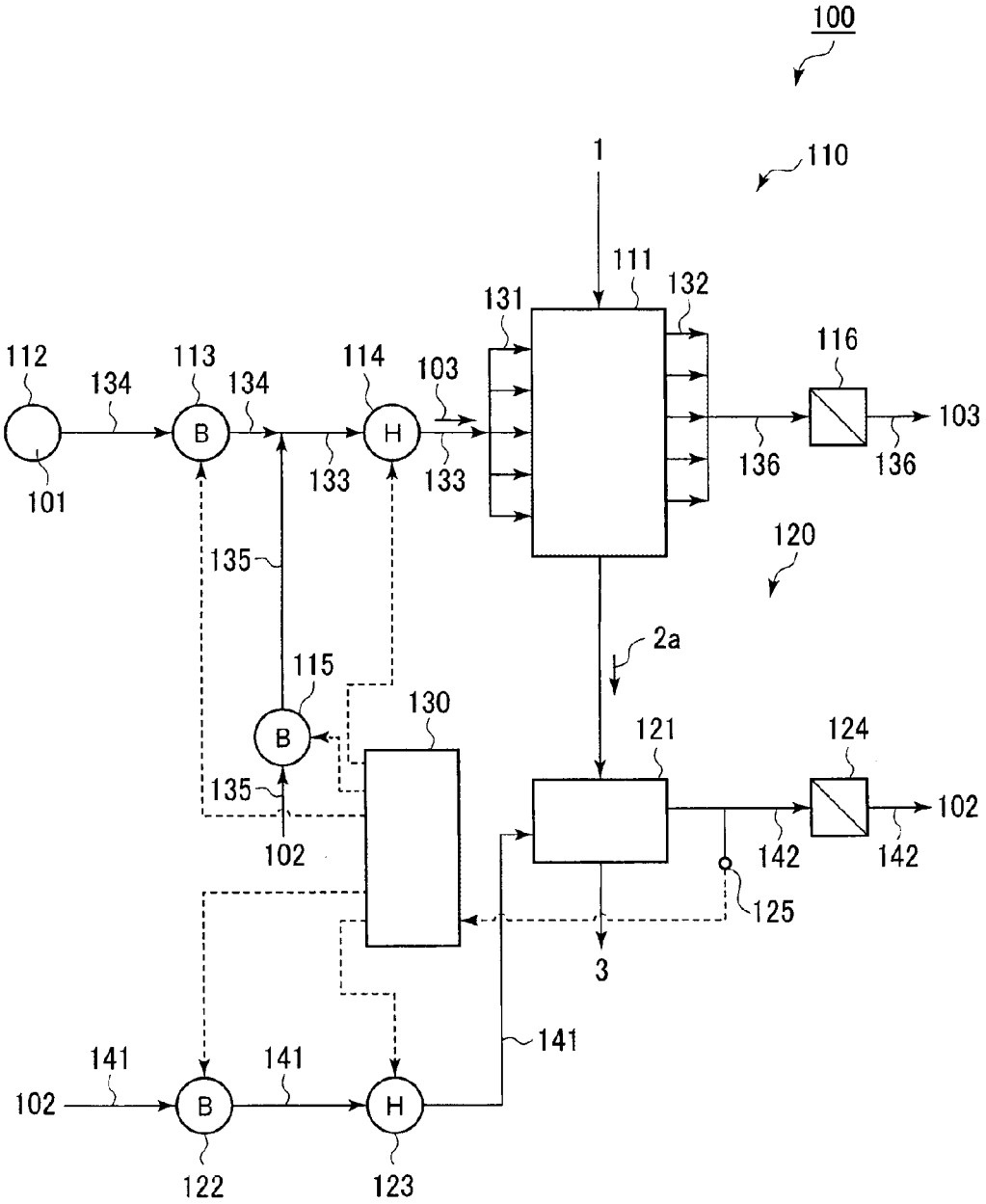
FIG. 1 is a schematic configuration diagram of a first embodiment of a coal deactivation processing device in the present invention.

A first embodiment of the coal deactivation processing device in the present invention is described based on FIG. 1.

As shown in FIG. 1, above a first processing device main body (processing tower) 111 of a first processing device 110 in which pyrolized coal 1 flows from an upper side being one side to a lower side being another side, there is provided a supply chamber (not illustrated) configured to supply the pyrolized coal 1 into the first processing device main body 111, the pyrolized coal 1 being coal produced by drying and pyrolizing low-grade coal. Below the first processing device main body 111, there is provided a second processing device main body 121 of a second processing device 120 which receives first processed pyrolized coal 2*a* processed in the first processing device main body 111 from the upper side being the one side and in which the first processed pyrolized coal 2*a* flows to the lower side being the other side.

Front end sides of multiple introduction pipes 131 and base end sides of multiple exhaust pipes 132 are connected to the first processing device main body 111 in a manner arranged in an up-down direction, the introduction pipes 131 configured to introduce processing gas (first processing gas) 103 containing oxygen into the first processing device main body 111, the exhaust pipes 132 configured to exhaust the processing gas 103 flowing through the inside of the first processing device main body 111 to the outside.

A front end side of a feed pipe 133 configured to feed the processing gas 103 is connected to base end sides of the introduction pipes 131. A front end side of an air supply pipe 135 configured to supply air 102 and a front end side of a nitrogen supply pipe 134 configured to supply nitrogen gas 101 are connected to a base end side of the feed pipe 133. A base end side of the nitrogen supply pipe 134 is connected to a nitrogen gas supply source 112 such as a nitrogen gas tank. A base end side of the air supply pipe 135 is opened to the atmosphere.

A blower 115 is provided in the middle of the air supply pipe 135 and a blower 113 is provided in the middle of the nitrogen supply pipe 134. A heater 114 is provided in the middle of the feed pipe 133.

Specifically, by activating the blowers 113, 115, the processing gas 103 produced by mixing the nitrogen gas 101 from the nitrogen gas supply source 112 and the air 102 from the outside can be fed into the first processing device main body 111 while being heated by the heater 114. Here, the oxygen gas concentration in the processing gas 103 can be adjusted by adjusting the amounts of the nitrogen gas 101 and the air 102 fed from the blowers 113, 115. Moreover, the temperature of the processing gas 103 can be adjusted by adjusting the heater 114.

Front end sides of the exhaust pipes 132 are connected to a base end side of a delivery pipe 136. A filter 116 configured to remove dusts in the gas is provided in the middle of the delivery pipe 136.

A front end side of an introduction pipe 141 and a base end side of an exhaust pipe 142 are connected to the second processing device main body 121, the introduction pipe 141 configured to introduce the air 102 into the second processing device main body 121 as second processing gas containing a predetermined concentration of oxygen, the exhaust pipe 142 configured to exhaust the air 102 flowing through the inside of the second processing device main body 121 to the outside.

A base end side of the introduction pipe 141 is opened to the atmosphere. A blower 122 and a heater 123 are provided in the middle of the introduction pipe 141.

A filter 124 configured to remove dust in the gas is provided in the middle of the exhaust pipe 142.

A CO sensor (second-processing-gas carbon monoxide concentration detection means) 125 configured to detect the carbon monoxide concentration of the gas flowing inside the exhaust pipe 142 in a gaseous state is provided between the base end side of the exhaust pipe 142 and the filter 124.

The CO sensor 125 is electrically connected to an input unit of a control device 130 which is control means. An output unit of the control device 130 is connected to the blowers 113, 115, 122 and the heaters 114, 123, and the control device 130 can control operations of the blowers 113, 115, 122 and the heaters 114, 123 on the basis of information from the CO sensor 125 and the like.

Note that any device conventionally used for deactivation processing can be used as the first processing device main body 111, provided that the device is capable of exposing supplied coal, for example, the pyrolized coal 1 to an atmosphere of a predetermined oxygen concentration for a predetermined period of time and that the device is less likely to be affected by heat from the outside. Moreover, any device having a structure similar to that of the first processing device main body 111 and being smaller than the first processing device main body 111 can be used as the second processing device main body 121, provided that the device is capable of exposing supplied coal, for example, the first processed pyrolized coal 2*a* to an atmosphere of a predetermined oxygen concentration for a predetermined period of time and that the device is less likely to be affected by heat from the outside.

In the embodiment described above, first-processing-gas feeding means is formed of the nitrogen gas supply source 112, the blowers 113, 115, the nitrogen supply pipe 134, the air supply pipe 135, the feed pipe 133, the introduction pipes 131, and the like; first-processing-gas oxygen concentration adjustment means is formed of the blowers 113, 115 and the like; first-processing-gas temperature adjustment means is formed of the heater 114 and the like; second-processing-gas feeding means is formed of the blower 122, the introduction pipe 141, and the like; and second-processing-gas temperature adjustment means is formed of the heater 123 and the like. Second-processing-gas state detection means for detecting the state of the second processing gas, specifically, second-processing-gas oxygen concentration detection means is formed of the CO sensor 125 and the like. This is because: carbon monoxide in the air 102 exhausted from the second processing device main body 121 is a gas generated when the first processed pyrolized coal 2*a* is subjected to the deactivation processing in the second processing device main body 121; the amount of carbon monoxide contained in the outside air 102 is ppm-level; oxygen in the air 102 in the second processing device main body 121 decreases due to reaction with the first processed pyrolized coal 2*a*; and it is thus possible to indirectly detect the oxygen concentration in the air 102 exhausted from the second processing device main body 121 by detecting the carbon monoxide concentration in the air 102 exhausted from the second processing device main body 121.

Next, operations of the aforementioned coal deactivation processing device 100 are described.

When the pyrolized coal 1 is supplied into the first processing device main body 111 and the control device 130 is activated, the control device 130 controls the blowers 113, 115 and the heater 114 such that the processing gas 103 of a predetermined oxygen concentration (for example, 9%) and of a predetermined temperature (for example, 50° C.) is fed into the first processing device main body 111. Moreover, the control device 130 controls the blower 122 and the heater 123 such that the air 102 (oxygen concentration: about 20%) of a predetermined temperature (for example, 30° C.) is fed into the second processing device main body 121.

The pyrolized coal 1 supplied into the first processing device main body 111 is turned into the first processed pyrolized coal 2*a* which is oxidized and whose activity is reduced, by the processing gas 103. The first processed pyrolized coal 2*a* subjected to such deactivation processing in the first processing device main body 111 for a predetermined period of time (for example, 15 hours) is sent out from a lower portion of the first processing device main body 111. The used processing gas 103 in the first processing device main body 111 after the deactivation of the pyrolized coal 1 is exhausted from the inside of the first processing device main body 111, subjected to dust removal in the filter 116, and exhausted to the outside.

The first processed pyrolized coal 2*a* sent out from the first processing device main body 111 is supplied into the second processing device main body 121. The first processed pyrolized coal 2*a* supplied into the second processing device main body 121 is turned into upgraded coal 3 which is further oxidized and whose activity is further reduced, by the air 102 adjusted to the predetermined temperature (for example, 30° C.). The upgraded coal 3 produced by being subjected to such deactivation processing in the second processing device main body 121 for a predetermined period of time (for example, 1.5 hours) is discharged to the outside from a lower portion of the second processing device main body 121.

In other words, the deactivation processing and cooling of the first processed pyrolized coal 2*a* is performed in the second processing device main body 121.

The used air 102 in the second processing device main body 121 after the deactivation of the first processed pyrolized coal 2*a* is exhausted from the inside of the second processing device main body 121, and the carbon monoxide concentration of the air 102 is detected by the CO sensor 125 continuously or every predetermined period of time (for example, every two hours). Note that the air 102 whose carbon monoxide concentration has been detected is subjected to dust removal in the filter 124 and is exhausted to the outside.

Based on information from the CO sensor 125, data of carbon monoxide concentration in the air (for example, 2 ppm or less), and the like, the control device 130 determines whether a difference of the carbon monoxide concentration is greater than a predetermined value C1 or equal to or less than the predetermined value C1.

When the difference of the carbon monoxide concentration is greater than the predetermined value C1, the control device 130 determines that oxidation activity of the first processed pyrolized coal 2*a* is still high and deactivation of the first processed pyrolized coal 2*a* by the processing gas 103 is insufficient in the first processing device main body 111, and controls the blowers 113, 115 such that the oxygen concentration of the processing gas 103 is increased. This can promote the reaction between the pyrolized coal 1 and oxygen of the processing gas 103 in the first processing device main body 111.

When the difference of the carbon monoxide concentration is equal to or less than the predetermined value C1, the control device 130 determines that the first processed pyrolized coal 2*a* is excessively deactivated by the processing gas 103 in the first processing device main body 111, and controls the blowers 113, 115 such that the oxygen concentration of the processing gas 103 is reduced. This can suppress the reaction between the pyrolized coal 1 and oxygen of the processing gas 103 in the first processing device main body 111.

Accordingly, in the first processing device main body 111, when the control device 130 determines that the state of the air 102 exhausted from the inside of the second processing device main body 121 is deviated from a predetermined state on the basis of information from the CO sensor 125 and the like, the processing rate of the deactivation of the pyrolized coal 1 is appropriately adjusted by controlling the blowers 113, 115 such that the oxygen concentration in the processing gas 103 is adjusted, and the degree of inactivity of the first processed pyrolized coal 2*a* fed from the first processing device main body 111 to the second processing device main body 121 is thus maintained within an appropriate range. The first processed pyrolized coal 2*a* is thereby subjected to the deactivation processing at a constant rate in the second processing device main body 121 by oxygen of the air 102, and the upgraded coal 3 adjusted to an appropriate degree of inactivity can be thus obtained.

Accordingly, in the coal deactivation processing device 100 of the embodiment, the deactivation processing can be easily performed under necessary and sufficient conditions corresponding to characteristics (for example, type of coal, particle diameter, amount of water content, stored period, and the like) of the pyrolized coal 1 supplied into the first processing device main body 111 and to pyrolysis conditions (for example, pyrolysis temperature, pyrolysis time, pyrolysis processing amount, and the like) of the pyrolized coal 1, even when the characteristics and pyrolysis conditions of the pyrolized coal 1 vary over time. Moreover, unlike the conventional coal deactivation processing device, there is no need to take part of the upgraded coal produced by subjecting the pyrolized coal to the deactivation processing as a sample, and the oxygen concentration of the processing gas 103 to be fed to the first processing device main body 111 can be adjusted based on the oxygen concentration, actually the carbon monoxide concentration, in the air 102 exhausted from the second processing device main body 121. In addition, since the pyrolized coal 1, 2*a* can be subjected to the deactivation processing in the first processing device main body 111 and the second processing device main body 121, the upgraded coal 3 adjusted to an appropriate degree of inactivity can be easily obtained.

Since the outside air 102 only contains carbon monoxide of about 2 ppm or less and the carbon monoxide is generated in the deactivation processing of the first processed pyrolized coal 2*a*, using the CO sensor 125 configured to detect the carbon monoxide concentration of the air 102 exhausted from the inside of the second processing device main body 121 enables accurate determination of the degree of activity of the first processed pyrolized coal 2*a* based on the carbon monoxide concentration detected by the CO sensor 125. Accordingly, it is possible to more appropriately adjust the oxygen concentration of the processing gas 103 and more appropriately subject the pyrolized coal 1, 2*a* to the deactivation processing in the first processing device main body 111 and the second processing device main body 121. Hence, the upgraded coal 3 adjusted to a more appropriate degree of inactivity can be easily obtained.

Second Embodiment

Figure 2:
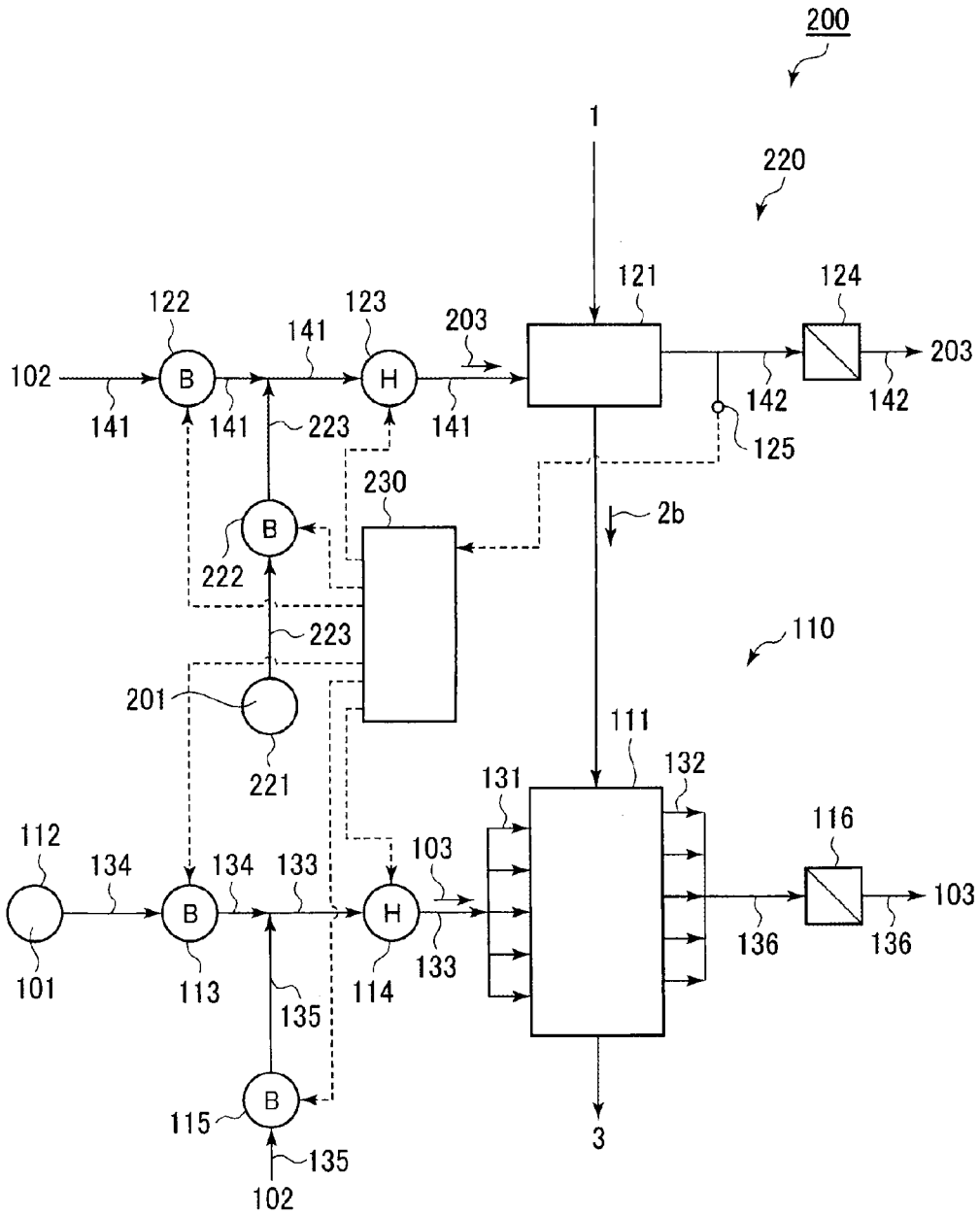
FIG. 2 is a schematic configuration diagram of a second embodiment of the coal deactivation processing device in the present invention.

A second embodiment of the coal deactivation processing device in the present invention is described based on FIG. 2.

The embodiment has a configuration in which the installed position of the second processing device main body included in the aforementioned first embodiment shown in FIG. 1 is changed. Other configurations are substantially the same as those described above and shown in FIG. 1. The same devices are denoted by the same reference numerals and overlapping description is omitted as appropriate.

As shown in FIG. 2, above the first processing device main body 111, there is provided the second processing device main body 121 of a second processing device 220 in which the pyrolized coal 1 being coal produced by drying and pyrolizing low-grade coal flows from the upper side being the one side to the lower side being the other side. Below the second processing device main body 121, there is provided the first processing device main body 111 which receives the first processed pyrolized coal 2*a* processed in the second processing device main body 121 from the upper side being the one side and in which the first processed pyrolized coal 2*a* flows to the lower side being the other side.

The front end side of the introduction pipe 141 and the base end side of the exhaust pipe 142 are connected to the second processing device main body 121, the introduction pipe 141 configured to introduce processing gas 203 into the second processing device main body 121 as second processing gas containing a predetermined concentration of oxygen, the exhaust pipe 142 configured to exhaust the processing gas 203 flowing through the inside of the second processing device main body 121 to the outside.

A front end side of a nitrogen supply pipe 223 configured to supply nitrogen gas 201 is connected to a portion of the introduction pipe 141 between the blower 122 and the heater 123. A base end side of the nitrogen supply pipe 223 is connected to a nitrogen gas supply source 221 such as a nitrogen gas tank. A blower 222 is provided in the middle of the nitrogen supply pipe 223.

Specifically, by activating the blowers 222, 122, the processing gas 203 produced by mixing the nitrogen gas 201 from the nitrogen gas supply source 221 and the outside air 102 can be fed into the second processing device main body 121 while being heated by the heater 123. Here, the processing gas 203 can be made to serve as the second processing gas containing a predetermined concentration of oxygen, by adjusting the amounts of the nitrogen gas 201 and the air 102 fed from the blowers 222, 122. Moreover, the temperature of the processing gas 203 can be adjusted by adjusting the heater 123.

The CO sensor 125 provided between the base end side of the exhaust pipe 142 and the filter 124 is electrically connected to an input unit of a control device 230 which is the control means. An output unit of the control device 230 is connected to the blowers 113, 115, 122, 222 and the heaters 114, 123, and the control device 230 can control operations of the blowers 113, 115, 122, 222 and the heaters 114, 123 on the basis of information from the CO sensor 125 and the like.

In the embodiment described above, the second-processing-gas feeding means is formed of the nitrogen gas supply source 221, the blowers 122, 222, the introduction pipe 141, the nitrogen supply pipe 223, and the like; and second-processing-gas oxygen concentration adjustment means is formed of the blowers 122, 222 and the like.

Next, operations of the aforementioned coal deactivation processing device 200 are described.

When the pyrolized coal 1 is supplied into the second processing device main body 121 and the control device 230 is activated, the control device 230 controls the blowers 122, 222 and the heater 123 such that the processing gas 203 of a predetermined oxygen concentration (for example, 2%) and of a predetermined temperature (for example, 50° C.) is fed into the second processing device main body 121. Moreover, the control device 230 controls the blowers 113, 115 and the heater 114 such that the processing gas 103 of a predetermined oxygen concentration (for example, 2%) and of a predetermined temperature (for example, 50° C.) is fed into the first processing device main body 111. In other words, the processing gas 203 which is the second processing gas whose oxygen concentration is adjusted to a predetermined concentration is fed into the second processing device main body 121.

The pyrolized coal 1 supplied into the second processing device main body 121 is turned into the first processed pyrolized coal 2*b* which is oxidized and whose activity is reduced, by the processing gas 203. The first processed pyrolized coal 2*b* subjected to such deactivation processing in the second processing device main body 121 for a predetermined period of time (for example, 1.5 hours) is sent out from the lower portion of the second processing device main body 121. The used processing gas 203 in the second processing device main body 121 after the deactivation of the pyrolized coal 1 is exhausted from the inside of the second processing device main body 121, and the carbon monoxide concentration of the processing gas 203 is detected by the CO sensor 125 continuously or every predetermined period of time (for example, every two hours). Note that the used processing gas 203 after the detection of the oxygen concentration is subjected to dust removal in the filter 124 and is exhausted to the outside.

The first processed pyrolized coal 2*b* sent out from the second processing device main body 121 is supplied into the first processing device main body 111. The first processed pyrolized coal 2*b* supplied into the first processing device main body 111 is turned into the upgraded coal 3 which is further oxidized and whose activity is further reduced compared to that of the first processed pyrolized coal 2*b*, by the processing gas 103. The upgraded coal 3 subjected to such deactivation processing in the first processing device main body 111 for a predetermined period of time (for example, 15 hours) is discharged to the outside from the lower portion of the first processing device main body 111. Note that the used processing gas 103 in the first processing device main body 111 after the deactivation of the first processed pyrolized coal 2*b* is exhausted from the inside of the first processing device main body 111, subjected to dust removal in the filter 116, and exhausted to the outside.

Based on the information from the CO sensor 125, the data of the carbon monoxide concentration in the air (for example, 2 ppm or less), the operations of the blowers 122, 222, and the like, the control device 230 determines whether a difference of the carbon monoxide concentration is greater than a predetermined value C2 or equal to or less than the predetermined value C2. This is because: the degree of activity of the pyrolized coal 1 can be obtained from the difference of the carbon monoxide concentration; an oxygen adsorption amount required to obtain the upgraded coal 3 adjusted to an appropriate degree of inactivity can be obtained from the degree of activity of the pyrolized coal 1; and the oxygen concentration of the processing gas 103 to be fed into the first processing device main body 111 can be obtained from the oxygen adsorption amount required to obtain the upgraded coal 3 adjusted to the appropriate degree of inactivity and from the oxygen concentration of the processing gas 203 discharged from the inside of the second processing device 121.

When the difference of the carbon monoxide concentration is greater than the predetermined value C2, the control device 230 determines that oxidation activity of the upgraded coal 3 is to be still high even if the first processed pyrolized coal 2*b* is subjected to the deactivation processing by the processing gas 103 whose oxygen concentration is adjusted by the blowers 113, 115 and that the deactivation of the upgraded coal 3 is insufficient, and controls the blowers 113, 115 such that the oxygen concentration of the processing gas 103 is increased. This can promote the reaction between the first processed pyrolized coal 2*b* and oxygen of the processing gas 103 in the first processing device main body 111.

When the difference of the carbon monoxide concentration is equal to or less than the predetermined value C2, the control device 230 determines that the upgraded coal 3 is to be excessively deactivated by the processing gas 103 if the first processed pyrolized coal 2*b* is subjected to the deactivation processing by the processing gas 103 whose oxygen concentration is adjusted by the blowers 113, 115, and controls the blowers 113, 115 such that the oxygen concentration of the processing gas 103 is reduced. This can suppress the reaction between the first processed pyrolized coal 2*b* and oxygen of the processing gas 103 in the first processing device main body 111.

Accordingly, in the first processing device main body 111, when the control device 230 determines that the state of the processing gas 203 exhausted from the inside of the second processing device main body 121 is deviated from a predetermined state on the basis of information from the CO sensor 125 and the like, the processing rate of the deactivation of the first processed pyrolized coal 2*b* is appropriately adjusted by controlling the blowers 113, 115 such that the oxygen concentration in the processing gas 103 is adjusted, and the upgraded coal 3 adjusted to an appropriate degree of inactivity can be thus obtained.

Accordingly, in the coal deactivation processing device 200 of the embodiment, operations and effects similar to those of the embodiment described above can be obtained.

Third Embodiment

Figure 3:
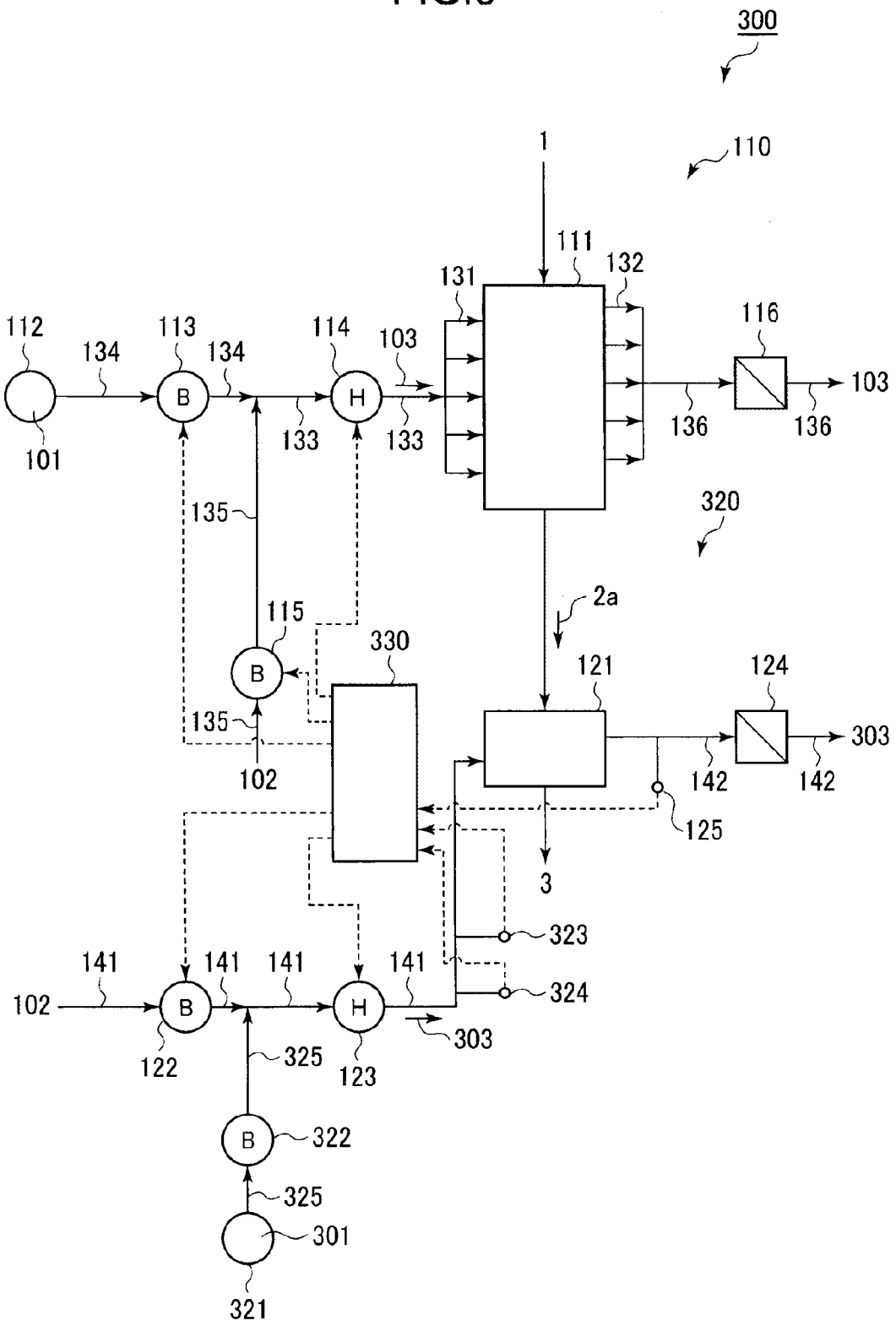
FIG. 3 is a schematic configuration diagram of a third embodiment of the coal deactivation processing device in the present invention.

A third embodiment of the coal deactivation processing device in the present invention is described based on FIG. 3.

The embodiment has a configuration in which a configuration for mixing inert gas into air gas is added, the air gas being the second processing gas to be fed to the second processing device main body included in the aforementioned first embodiment shown in FIG. 1. Other configurations are substantially the same as those described above and shown in FIG. 1. The same devices are denoted by the same reference numerals and overlapping description is omitted as appropriate.

As shown in FIG. 3, a front end side of an inert gas supply pipe 325 configured to supply inert gas 301 is connected to a portion of the introduction pipe 141 between the blower 122 and the heater 123. A base end side of the inert gas supply pipe 325 is connected to an inert gas supply source 321 such as a nitrogen gas tank or the processing gas 103 exhausted from the inside of the first processing device main body 111. A blower 322 is provided in the middle of the inert gas supply pipe 325.

Specifically, by activating the blowers 322, 122, processing gas 303 produced by mixing the inert gas 301 from the inert gas supply source 321 and the outside air 102 can be fed into the second processing device main body 121 of a second processing device 320 while being heated by the heater 123. Here, the processing gas 303 can be made to serve as the second processing gas containing a predetermined concentration of oxygen, by adjusting the amounts of the inert gas 301 and the air 102 fed from the blowers 322, 122. Moreover, the temperature of the processing gas 303 can be adjusted by adjusting the heater 123.

A CO sensor 323 and an $O_2$ sensor 324 which respectively detect the carbon monoxide concentration and the oxygen concentration of the processing gas 303 flowing in the introduction pipe 141 are provided between the front end side of the introduction pipe 141 and the heater 123. The CO sensors 125, 323 and the $O_2$ sensor 324 are electrically connected to an input unit of a control device 330 which is the control means. An output unit of the control device 330 is electrically connected to the blowers 113, 115, 122, 322 and the heaters 114, 123, and the control device 330 can control operations of the blowers 113, 115, 122, 322 and the heaters 114, 123 on the basis of information from the CO sensors 125, 323, the $O_2$ sensor 324, and the like.

In the embodiment described above, the second-processing-gas feeding means is formed of the inert gas supply source 321, the blowers 122, 322, the introduction pipe 141, the inert gas supply pipe 325, and the like; and the second-processing-gas oxygen concentration adjustment means is formed of the blowers 122, 322 and the like.

Next, operations of the aforementioned coal deactivation processing device 300 are described.

When the pyrolized coal 1 is supplied into the first processing device main body 111 and the control device 330 is activated, the control device 330 controls the blowers 113, 115 and the heater 114 such that the processing gas 103 of a predetermined oxygen concentration (for example, 9%) and of a predetermined temperature (for example, 50° C.) is fed into the first processing device main body 111. Moreover, the control device 330 controls the blowers 122, 322 and the heater 123 such that the processing gas 303 of a predetermined temperature (for example, 30° C.) and of a predetermined oxygen concentration (for example, 2%) is fed into the second processing device main body 121.

The pyrolized coal 1 supplied into the first processing device main body 111 is turned into the first processed pyrolized coal 2*a* which is oxidized and whose activity is reduced, by the processing gas 103. The first processed pyrolized coal 2*a* subjected to such deactivation processing in the first processing device main body 111 for a predetermined period of time (for example, 15 hours) is sent out from the lower portion of the first processing device main body 111.

The first processed pyrolized coal 2*a* sent out from the first processing device main body 111 is supplied into the second processing device main body 121. The first processed pyrolized coal 2*a* supplied into the second processing device main body 121 is turned into the upgraded coal 3 which is further oxidized and whose activity is further reduced, by the processing gas 303 adjusted to the predetermined temperature (for example, 30° C.) and to the predetermined oxygen concentration. The upgraded coal 3 produced by being subjected to such deactivation processing in the second processing device main body 121 for a predetermined period of time (for example, 1.5 hours) is discharged to the outside from the lower portion of the second processing device main body 121.

In other words, the deactivation processing and cooling of the first processed pyrolized coal 2*a* is performed in the second processing device main body 121.

The used processing gas 303 in the second processing device main body 121 after the deactivation of the first processed pyrolized coal 2*a* is exhausted from the inside of the second processing device main body 121, and the carbon monoxide concentration of the processing gas 303 is detected by the CO sensor 125 continuously or every predetermined period of time (for example, every two hours).

Moreover, the carbon monoxide concentration and the oxygen concentration of the processing gas 303 to be fed into the second processing device main body 121 are detected respectively by the CO sensor 323 and the $O_2$ sensor 324 continuously or every predetermined period of time (for example, every two hours).

Based on information from the CO sensors 125, 323 and the $O_2$ sensor 324, the control device 330 determines whether a difference of the carbon monoxide concentration is greater than a predetermined value C3 or equal to or less than the predetermined value C3.

When the difference of the carbon monoxide concentration is greater than the predetermined value C3, the control device 330 determines that oxidation activity of the first processed pyrolized coal 2*a* is still high and deactivation of the first processed pyrolized coal 2*a* by the processing gas 103 in the first processing device main body 111 is insufficient, and controls the blowers 113, 115 such that the oxygen concentration of the processing gas 103 is increased. This can promote the reaction between the pyrolized coal 1 and oxygen of the processing gas 103 in the first processing device main body 111.

When the difference of the carbon monoxide concentration is equal to or less than the predetermined value C3, the control device 330 determines that the first processed pyrolized coal 2*a* is excessively deactivated by the processing gas 103 in the first processing device main body 111, and controls the blowers 113, 115 such that the oxygen concentration of the processing gas 103 is reduced. This can suppress the reaction between the pyrolized coal 1 and oxygen of the processing gas 103 in the first processing device main body 111.

Accordingly, in the first processing device main body 111, when the control device 330 determines that the state of the processing gas 303 exhausted from the inside of the second processing device main body 121 is deviated from a predetermined state on the basis of information from the CO sensors 125, 323 and the $O_2$ sensor 324 and the like, the processing rate of the deactivation of the pyrolized coal 1 is appropriately adjusted by controlling the blowers 113, 115 such that the oxygen concentration in the processing gas 103 is adjusted, and the degree of inactivity of the first processed pyrolized coal 2*a* fed from the first processing device main body 111 to the second processing device main body 121 is thus maintained within an appropriate range. The first processed pyrolized coal 2*a* is thereby subjected to the deactivation processing at a constant rate in the second processing device main body 121 by oxygen of the processing gas 303, and the upgraded coal 3 adjusted to an appropriate degree of inactivity can be thus obtained.

Accordingly, in the coal deactivation processing device 300 of the embodiment, the deactivation processing can be easily performed under necessary and sufficient conditions corresponding to characteristics (for example, type of coal, particle diameter, amount of water content, stored period, and the like) of the pyrolized coal 1 supplied into the first processing device main body 111 and to pyrolysis conditions (for example, pyrolysis temperature, pyrolysis time, pyrolysis processing amount, and the like) of the pyrolized coal 1, even when the characteristics and pyrolysis conditions of the pyrolized coal 1 vary over time. Moreover, unlike the conventional coal deactivation processing device, there is no need to take part of the upgraded coal produced by subjecting the pyrolized coal to the deactivation processing as a sample, and the oxygen concentration of the processing gas 103 to be fed to the first processing device main body 111 can be more appropriately adjusted based on the carbon monoxide concentration and the oxygen concentration in the processing gas 303 to be fed into the second processing device main body 121 and the carbon monoxide in the processing gas 303 exhausted from the second processing device main body 121. In addition, the pyrolized coal 1, 2*a* can be more appropriately subjected to the deactivation processing in the first processing device main body 111 and the second processing device main body 121. Hence, the upgraded coal 3 adjusted to a more appropriate degree of inactivity can be easily obtained.

Other Embodiments

Although the CO sensor 125 is provided in the exhaust pipe 142 to actually detect the carbon monoxide concentration of the used air 102 or processing gas 203, 303 exhausted from the second processing device main body 121 in the embodiments described above, as another embodiment, it is possible to provide, for example, a $CO_2$ sensor (second-processing-gas carbon dioxide concentration detection means) and actually detect the carbon dioxide concentration of the used air 102 or processing gas 203, 303 exhausted from the second processing device main body 121.

Moreover, the following configuration can be employed as another embodiment. For example, an $O_2$ sensor (second-processing-gas oxygen concentration detection means) is provided to actually detect the oxygen concentration of the used air 102 or processing gas 203, 303 exhausted from the second processing device main body 121. When a difference of the oxygen concentration is determined to be less than a predetermined value C4 on the basis of information from the $O_2$ sensor, data on the oxygen concentration in the air, information from the $O_2$ sensor 324, and the like, the blowers 113, 115 are controlled to increase the oxygen concentration of the processing gas 103, and the reaction between oxygen of the processing gas 103 and the pyrolized coal 1 or the first processed pyrolized coal 2*b* is thereby promoted. When the difference of the oxygen concentration is equal to or greater than the predetermined value C4, the blowers 113, 115 are controlled to reduce the oxygen concentration of the processing gas 103, and the reaction between oxygen of the processing gas 103 and the pyrolized coal 1 or the first processed pyrolized coal 2*b* is thereby suppressed. In other words, also in such an embodiment, the upgraded coal 3 adjusted to an appropriate degree of inactivity can be easily obtained as in the embodiments described above.

Furthermore, the following configuration may be employed as another embodiment. For example, a temperature sensor (second-processing-gas temperature detection means) is provided to detect the temperature of the used air 102 or processing gas 203, 303 exhausted from the second processing device main body 121. When a difference of the temperature is determined to be equal to or less than a predetermined value T1 on the basis of information from the temperature sensor, an operation of the heater 123, and the like, the blowers 113, 115 are controlled to reduce the oxygen concentration of the processing gas 103, and the reaction between oxygen of the processing gas 103 and the pyrolized coal 1 or the first processed pyrolized coal 2*b* is thereby suppressed. When the temperature difference is greater than the predetermined value T1, the blowers 113, 115 are controlled to increase the oxygen concentration of the processing gas 103, and the reaction between oxygen of the processing gas 103 and the pyrolized coal 1 or the first processed pyrolized coal 2*b* are promoted. In other words, also in such an embodiment, the upgraded coal 3 adjusted to an appropriate degree of inactivity can be easily obtained as in the embodiments described above.

In the above description, the oxygen concentration of the processing gas 103 is adjusted based on the difference of the carbon monoxide concentration, the difference of the carbon dioxide concentration, the difference of the oxygen concentration, and the difference of the temperature. However, the oxygen concentration of the processing gas 103 can be adjusted based on the carbon monoxide concentration, the carbon dioxide concentration, the oxygen concentration, or the temperature of the air 102 or processing gas 203, 303 exhausted from the second processing device main body 121.

INDUSTRIAL APPLICABILITY

Since upgraded coal adjusted to an appropriate degree of inactivity can be easily obtained, the coal deactivation processing device of the present invention can be extremely useful in the steel industry and the power generation industry.

EXPLANATIONS OF REFERENCE NUMERALS

1 PYROLIZED COAL
2*a*, 2*b* FIRST PROCESSED PYROLIZED COAL
3 UPGRADED COAL
100, 200, 300 COAL DEACTIVATION PROCESSING DEVICE
101 NITROGEN GAS
102 AIR
103 PROCESSING GAS
110 FIRST PROCESSING DEVICE
111 FIRST PROCESSING DEVICE MAIN BODY
112 NITROGEN GAS SUPPLY SOURCE
113, 115 BLOWER
114 HEATER
116 FILTER
120, 220, 320 SECOND PROCESSING DEVICE
121 SECOND PROCESSING DEVICE MAIN BODY
122, 222, 322 BLOWER
123 HEATER
124 FILTER
125, 323 CO SENSOR
130, 230, 330 CONTROL DEVICE
203 PROCESSING GAS
301 INERT GAS
303 PROCESSING GAS
321 INERT GAS SUPPLY SOURCE
324 $O_2$ SENSOR

The invention claimed is:

1. A coal deactivation processing device characterized in that, the coal deactivation processing device comprises:

a first processing device main body in which coal flows from one side to another side;

first-processing-gas feeding means for feeding first processing gas containing oxygen into the first processing device main body;

first-processing-gas oxygen concentration adjustment means for adjusting an oxygen concentration in the first processing gas;

first-processing-gas temperature adjustment means for adjusting a temperature of the first processing gas;

a second processing device main body which is located in a stage prior or subsequent to the first processing device main body and in which the coal or the coal processed in the first processing device main body flows from one side to another side;

second-processing-gas feeding means for feeding second processing gas containing a predetermined concentration of oxygen into the second processing device main body;

second-processing-gas state detection means for detecting a state of the second processing gas used to process the coal in the second processing device main body; and control means for controlling the first-processing-gas oxygen concentration adjustment means based on information from the second-processing-gas state detection means, such that the oxygen concentration in the first processing gas is adjusted, in response to determining that the state of the second processing gas deviates from a predetermined state.

2. The coal deactivation processing device according to claim 1, characterized in that the second-processing-gas state detection means is second-processing-gas oxygen concentration detection means for detecting an oxygen concentration of the second processing gas used to process the coal in the second processing device main body, and based on information from the second-processing-gas oxygen concentration detection means, the control means:

controls the first-processing-gas oxygen concentration adjustment means such that the oxygen concentration in the first processing gas is increased, when the oxygen concentration of the second processing gas is lower than a predetermined oxygen concentration; and controls the first-processing-gas oxygen concentration adjustment means such that the oxygen concentration in the first processing gas is reduced, when the oxygen concentration of the second processing gas is equal to or higher than the predetermined oxygen concentration.

3. The coal deactivation processing device according to claim 1, characterized in that the second-processing-gas state detection means is second-processing-gas carbon monoxide concentration detection means for actually detecting a carbon monoxide concentration or second-processing-gas carbon dioxide concentration detection means for actually detecting a carbon dioxide concentration, of the second processing gas used to process the coal in the second processing device main body, and based on information from the second-processing-gas carbon monoxide concentration detection means or the second-processing-gas carbon dioxide concentration detection means, the control means:

controls the first-processing-gas oxygen concentration adjustment means such that the oxygen concentration in the first processing gas is increased, when the carbon monoxide concentration or the carbon dioxide concentration in the second processing gas is higher than a predetermined concentration; and controls the first-processing-gas oxygen concentration adjustment means such that the oxygen concentration in the first processing gas is reduced, when the carbon monoxide concentration or the carbon dioxide concentration in the second processing gas is equal to or lower than the predetermined concentration.

4. The coal deactivation processing device according to claim 1, characterized in that the second-processing-gas state detection means is second-processing-gas temperature detection means for actually detecting a temperature of the second processing gas used to process the coal in the second processing device main body, and based on information from the second-processing-gas temperature detection means, the control means:

controls the first-processing-gas oxygen concentration adjustment means such that the oxygen concentration in the first processing gas is reduced, when the temperature of the second processing gas is equal to or lower than a predetermined temperature; and controls the first-processing-gas oxygen concentration adjustment means such that the oxygen concentration in the first processing gas is increased, when the temperature of the second processing gas is higher than the predetermined temperature.

5. The coal deactivation processing device according to claim 1, characterized in that the coal deactivation processing device further comprises second-processing-gas temperature adjustment means for adjusting a temperature of the second processing gas.

6. The coal deactivation processing device according to claim 1, characterized in that the coal deactivation processing device further comprises second-processing-gas oxygen concentration adjustment means for adjusting an oxygen concentration of the second processing gas to a predetermined concentration.

7. The coal deactivation processing device according to claim 2, characterized in that the coal deactivation processing device further comprises second-processing-gas temperature adjustment means for adjusting a temperature of the second processing gas.

8. The coal deactivation processing device according to claim 3, characterized in that the coal deactivation processing device further comprises second-processing-gas temperature adjustment means for adjusting a temperature of the second processing gas.

9. The coal deactivation processing device according to claim 4, characterized in that the coal deactivation processing device further comprises second-processing-gas temperature adjustment means for adjusting a temperature of the second processing gas.

10. The coal deactivation processing device according to claim 2, characterized in that the coal deactivation processing device further comprises second-processing-gas oxygen concentration adjustment means for adjusting an oxygen concentration of the second processing gas to a predetermined concentration.

11. The coal deactivation processing device according to claim 3, characterized in that the coal deactivation processing device further comprises second-processing-gas oxygen concentration adjustment means for adjusting an oxygen concentration of the second processing gas to a predetermined concentration.

12. The coal deactivation processing device according to claim 4, characterized in that the coal deactivation processing device further comprises second-processing-gas oxygen concentration adjustment means for adjusting an oxygen concentration of the second processing gas to a predetermined concentration.

13. The coal deactivation processing device according to claim 5, characterized in that the coal deactivation processing device further comprises second-processing-gas oxygen concentration adjustment means for adjusting an oxygen concentration of the second processing gas to a predetermined concentration.

* * * * *